US010081915B2

(12) United States Patent
Constantine

(10) Patent No.: US 10,081,915 B2
(45) Date of Patent: Sep. 25, 2018

(54) TRACK RAIL FASTENING MECHANISM AND METHOD

(71) Applicant: Progress Rail Services Corporation, Albertville, AL (US)

(72) Inventor: Edward Constantine, Kansas City, MO (US)

(73) Assignee: Progress Rail Services Corporation, Albertville, AL (US)

( * ) Notice: Subject to any disclaimer, the term of this patent is extended or adjusted under 35 U.S.C. 154(b) by 259 days.

(21) Appl. No.: 15/215,225

(22) Filed: Jul. 20, 2016

(65) Prior Publication Data

US 2018/0023256 A1 Jan. 25, 2018

(51) Int. Cl.
*E01B 9/42* (2006.01)
*E01B 9/48* (2006.01)

(52) U.S. Cl.
CPC ..... *E01B 9/42* (2013.01); *E01B 9/483* (2013.01)

(58) Field of Classification Search
CPC ..... E01B 9/00; E01B 9/38; E01B 9/40; E01B 9/48; B21D 39/03
See application file for complete search history.

(56) References Cited

U.S. PATENT DOCUMENTS

| | | | | |
|---|---|---|---|---|
| 6,651,897 | B1 * | 11/2003 | Porrill | E01B 9/60 238/283 |
| 8,833,671 | B2 * | 9/2014 | Cox | E01B 9/60 238/336 |
| 9,297,122 | B2 * | 3/2016 | Bosterling | E01B 9/30 |
| 2002/0070283 | A1 * | 6/2002 | Young | E01B 9/38 238/264 |
| 2003/0084558 | A1 * | 5/2003 | Rada | E01B 1/002 29/428 |
| 2007/0235551 | A1 * | 10/2007 | Ellerhorst | E01B 9/685 238/283 |
| 2015/0060561 | A1 | 3/2015 | Ciloglu | |
| 2016/0298298 | A1 * | 10/2016 | Constantine | E01B 9/42 |
| 2018/0023256 | A1 * | 1/2018 | Constantine | E01B 9/483 |

FOREIGN PATENT DOCUMENTS

| | | |
|---|---|---|
| CN | 202247547 | 5/2012 |
| CN | 203065902 | 7/2013 |
| CN | 203755095 | 8/2014 |
| CN | 105297555 | 2/2016 |
| CN | 205046425 | 2/2016 |
| EP | 1079023 | 2/2001 |
| GB | 2199062 | 6/1988 |
| KR | 20060103664 | 10/2006 |
| WO | 2012160238 | 11/2012 |
| WO | 2013053972 | 4/2013 |

* cited by examiner

*Primary Examiner* — Jason C Smith
(74) *Attorney, Agent, or Firm* — Mattingly Burke Cohen & Biederman

(57) ABSTRACT

A mechanism for coupling a track rail to a substrate includes a rail plate and a base plate, where the rail plate surrounds the base plate. An overmolded coating is formed of a non-metallic material and encases the rail plate and the base plate. Related methodology is disclosed.

16 Claims, 3 Drawing Sheets

TRACK RAIL FASTENING MECHANISM AND METHOD

TECHNICAL FIELD

The present disclosure relates generally to fastening track rail to a substrate, and more particularly to a fastening mechanism with a base plate and a surrounding rail plate.

BACKGROUND

Rail equipment is widely used throughout the world for transportation of persons and all manner of goods. Rail lines formed by parallel track rails supported upon a concrete or gravel substrate will be familiar to most. Depending upon the manner of supporting the rails, and the type of substrate, different mechanisms are used for maintaining a desired positioning of the rails and, to a certain extent, attenuating shocks and vibrations transmitted between rail equipment and the underlying substrate. So-called "fixation" systems can range from relatively simple plates that attach rails to wooden ties partially buried in gravel, to more sophisticated mechanisms consisting of a relatively complex assembly of metallic and non-metallic components.

One known fixation system is set forth in United States Patent Application Publication No. 2015/0060561 to Ciloglu et al. Ciloglu et al. proposes a design where a section of track rail is supported between fasteners attached to a substrate and insulating elements. The design of Ciloglu et al. appears to be for the purpose of reducing corrosion-causing currents. The strategy is relatively complex, and for this and other reasons there remains ample room for improvement.

SUMMARY OF THE INVENTION

In one aspect, a fastening mechanism for coupling a track rail to a substrate includes a rail plate formed of a metallic material and including a lower side structured to face a substrate, and an upper side including a rail support surface extending between a front edge and a back edge of the rail plate. The rail plate further includes an outer perimeter and an inner perimeter defining an opening. The mechanism further includes a base plate formed of a metallic material, the base plate including a first lateral end and a second lateral end and having a first bore and a second bore formed therein, respectively. Each of the first bore and the second bore is structured to receive an anchor extending into the substrate. The base plate is positioned within the opening such that the rail plate surrounds the base plate and a gap extends peripherally between the rail plate and the base plate. The mechanism further includes an overmolded coating formed of a non-metallic material that is resiliently deformable relative to the metallic material. The overmolded coating encases the rail plate and the base plate and at least partially fills the gap to resiliently couple the rail plate and the base plate together.

In another aspect, a system for coupling a track rail to a substrate includes a fastening mechanism including a rail plate, a base plate, and an overmolded coating encasing the rail plate and the base plate. Each of the rail plate and the base plate are formed of a metallic material and the overmolded coating is formed of a non-metallic material. The rail plate includes a lower side structured to face a substrate, and an upper side including a rail support surface extending between a front edge and a back edge of the rail plate. The rail plate further includes an outer perimeter and an inner perimeter defining an opening. The base plate includes a first lateral end and a second lateral end having a first bore and a second bore formed therein, respectively, and each structured to receive an anchor extending into the substrate. The base plate is positioned within the opening such that a gap extends peripherally between the rail plate and the base plate, and the overmolded coating at least partially fills the gap.

In still another aspect, a method of fastening a track rail to a substrate includes attaching a base plate formed of a metallic material to a substrate by way of fasteners extending through bores in opposite lateral ends of the base plate. The method further includes positioning a rail plate formed of a metallic material and surrounding the base plate in a service orientation relative to the substrate by way of the attaching of the base plate. The method still further includes clamping a track rail against a rail support surface of the rail plate to establish a load transmission path between the track rail and the substrate by way of a resilient non-metallic material in an overmolded coating encasing the base plate and the rail plate.

DETAILED DESCRIPTION

Figure 1:
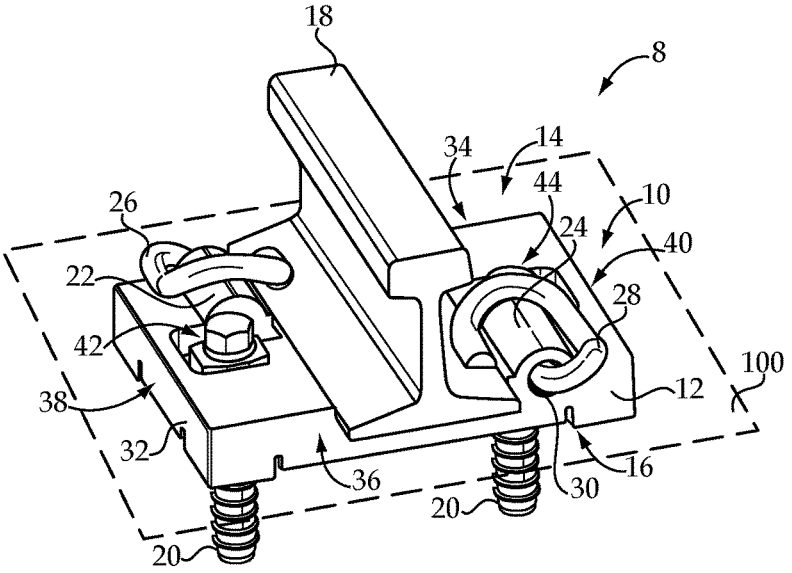
FIG. 1 is a diagrammatic view of a fastening mechanism for track rail, according to one embodiment.

Referring to FIG. 1, there is shown a rail fastening system 8 according to one embodiment, and structured for coupling a track rail 18 to a substrate 100. Substrate 100 may be a poured concrete substrate, however, the present disclosure is not thereby limited as such. System 8 includes a fastening mechanism 10 including a fastener body 12 having an upper side 14 whereupon track rail 18 is positioned, and a lower side 16 abutting substrate 100. A plurality of anchors 20 in the nature of bolts or the like are shown extending through fastener body 12, and into substrate 100 where they may be held fast. Anchors 20 might be cast in place within substrate 100, or received within threaded inserts within bores in substrate 100, for example. A first clip receiver 22 is a part of fastener body 12, as is a second clip receiver 24. A first clip 26 and a second clip 28 are received within bores in clip receivers 22 and 24, respectively. One such bore 30 is visible in FIG. 1. As will be further apparent from the following description, fastening mechanism 10 includes structure and components, some of which are not visible in FIG. 1, contemplated to provide various advantages relative to known designs, especially with regard to vibration and shock attenuation, lateral adjustability, packaging, and other factors.

Fastener body 12 further includes an outer perimeter 32 defining a generally rectangular footprint. Each clip receiver 22 and 24 may be positioned at least partially and may be entirely within the rectangular footprint. As will be further apparent from the following description, internal components of fastener body 12 including a rail plate not visible in FIG. 1 may have a similar rectangular footprint to fastener body 12 itself. Fastener body 12 further includes a front edge 34, a back edge 36, a left outboard edge 38, and a right outboard edge 40. Each of anchors 20 may be part of a first coupling or clamping mechanism 42 or a second coupling or clamping mechanism 44, as further described herein.

Figure 2:
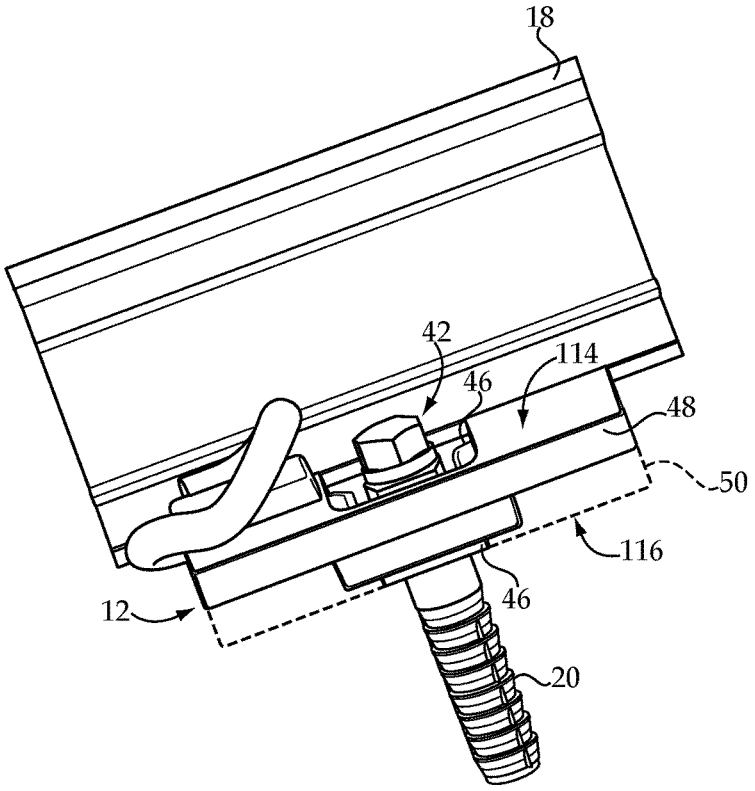
FIG. 2 is a side view of the mechanism of FIG. 1, showing certain features in phantom lines.

Referring also now to FIG. 2, there is shown a side view of parts of system 8, including fastener body 12 and certain components thereof. In particular, fastener body 12 may include a rail plate 48 and a base plate 46. Rail plate 48 may be formed of a metallic material, such as a steel or iron, and includes a lower side 116 structured to face a substrate, and an upper side 114 including a rail support surface not visible in FIG. 2. Base plate 46 may also be formed of a metallic material similar to rail plate 48, and an overmolded coating 50 formed of a non-metallic material that is resiliently deformable relative to the metallic material. The non-metallic material can include an elastomeric material, and could be formed of various natural or synthetic non-metallic materials and mixtures thereof. In FIG. 2 coating 50 is shown in phantom lines, and it can be seen that base plate 46 is partially vertically below, and surrounded by rail plate 48. Clamping mechanism 42 is seen to extend through both of base plate 46 and rail plate 48, as well as coating 50.

Figure 5:
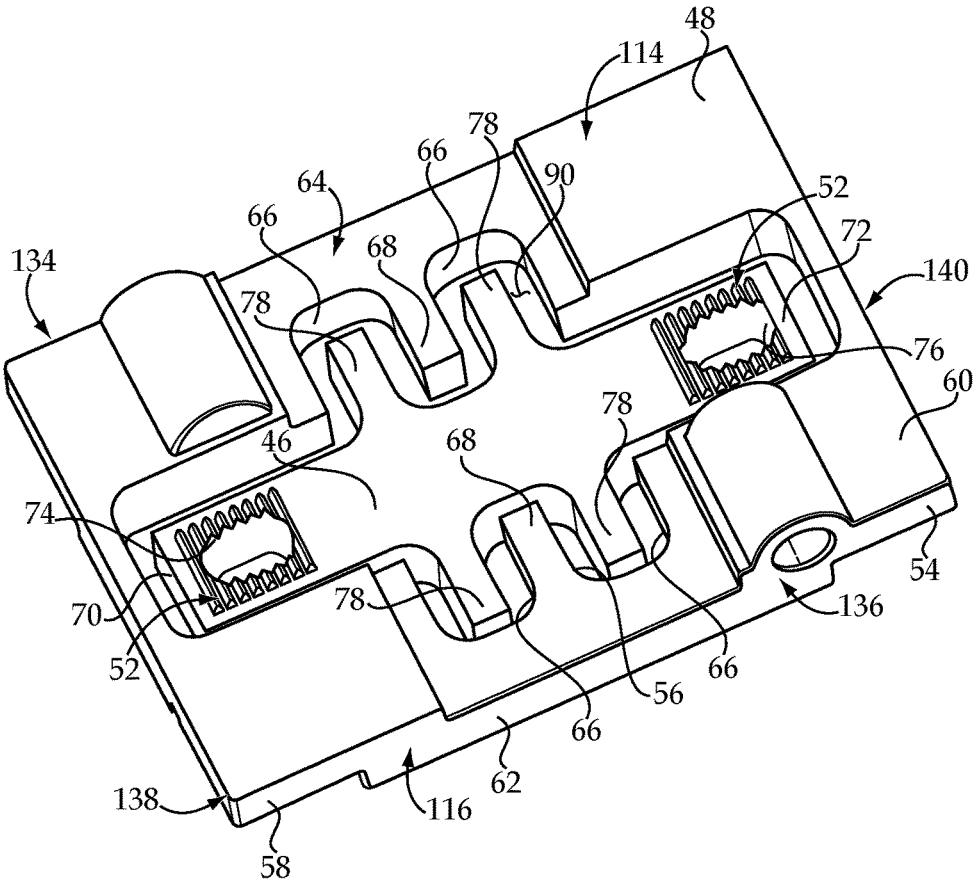
FIG. 5 is a diagrammatic view of certain components of a fastening mechanism, according to one embodiment.

Referring also now to FIG. 5, there is shown rail plate 48 and base plate 46 as they might appear positioned in an assembled state, but with coating 50 removed. When assembled for service coating 50 will generally hold rail plate 48 and base plate 46 in the configuration shown in FIG. 5. Upper side 114 of rail plate 48 includes a rail support surface 64 extending between a front edge 134 and a back edge 136 of rail plate 48. Embodiments are contemplated where coating 50 encases rail support surface 64, however, the present disclosure is not thereby limited. The present description of rail support surface 64 being a part of rail plate 48 intends the surface 64 also be understood as part of fastener body 12 as a whole. Rail plate 48 further includes outer perimeter 54 and an inner perimeter 56 defining an opening 66. It can be seen from FIG. 5 that a first section of rail support surface 64 extends between opening 66 and front edge 134, and a second section extends between back edge 136 and opening 66. It can also be seen from FIG. 5 that rail plate 48 may include a first outboard body section 58, a second outboard body section 60, and a core 62 extending laterally between first outboard body section 58 and second outboard body section 60. Clip receivers 22 and 24 may be attached to outboard body sections 58 and 60, respectively. Rail plate 48 also has a stepped up profile from core 62 to each of first and second outboard body sections 58 and 60. Base plate 46 includes a first lateral end 70 and a second lateral end 72, having a first bore 74 and a second bore 76 formed therein, respectively, and each structured to receive an anchor such as one of anchors 20 extending into the substrate. Base plate 46 might also have a stepped-up profile in laterally outward directions analogous to rail plate 48. In other words, ends 70 and 72 may be vertically raised somewhat from underlying substrate when base plate 46 is installed thereon. Non-metallic material of coating 50 might or might not extend vertically between the raised ends 70 and 72 and the underlying substrate. Base plate 46 is positioned within opening 66 such that rail plate 48 surrounds base plate 46. Base plate 46 is further sized and shaped such that a gap 90 extends peripherally between rail plate 48 and base plate 46.

It will be recalled that coating 50 is formed of a non-metallic material that is resiliently deformable relative to the metallic material of base plate 46 and rail plate 48, which metallic materials may be but are not necessarily the same. Coating 50 encases rail plate 48 and base plate 46 and at least partially fills gap 90 such that rail plate 48 and base plate 46 are resiliently coupled together. It can also be seen from FIG. 5 that gap 90 has a non-uniform contour and extends peripherally around base plate 46 such that base plate 46 is isolated from contact with rail plate 48. In a practical implementation strategy, base plate 46 extends horizontally between first lateral end 70 and second lateral end 72, and includes a plurality of prongs 78 projecting in a forward direction and a plurality of prongs also identified with reference numeral 78 projecting in a rearward direction. Prongs 72 may number only one in other embodiments. One or prongs (not numbered) of rail plate 48 may extend between prongs 72. In still other embodiments, neither of base plate 46 nor rail plate 48 includes prongs at all. While base plate 46 and rail plate 48 might have a wide variety of contours to define gap 90, a practical implementation includes shapes that are complementary to one another at least in core 62 and the adjacent parts of base plate 46.

Figure 3:
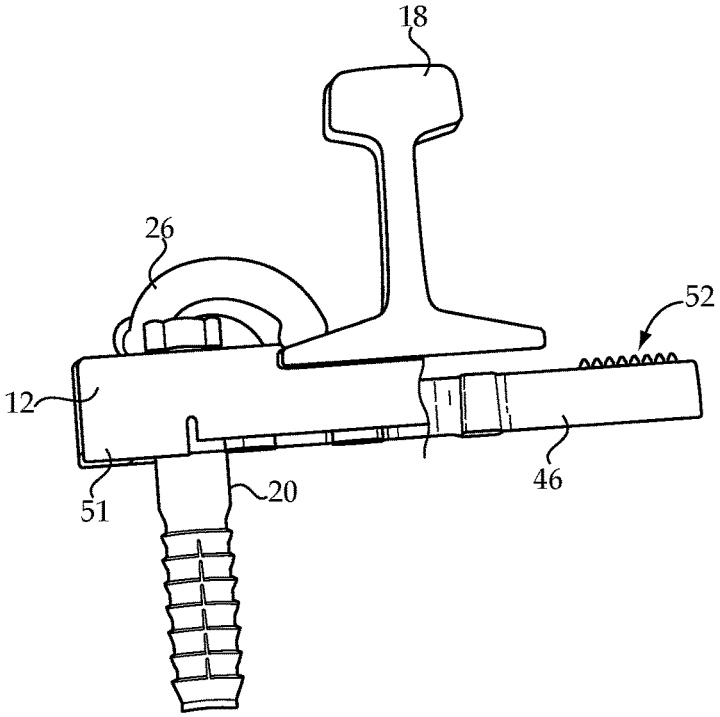
FIG. 3 is a partially open diagrammatic view of the fastening mechanism of FIGS. 1 and 2.
Figure 4:
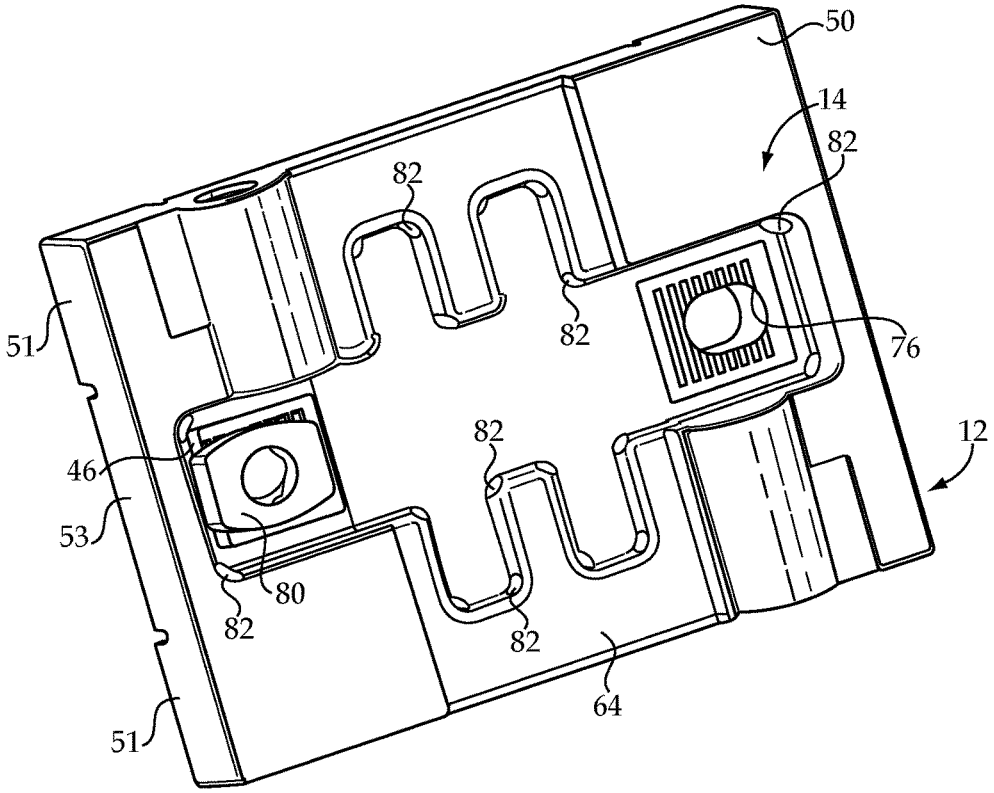
FIG. 4 is a diagrammatic view of a portion of the fastening mechanism of the system shown in FIGS. 1-3.

Referring also now to FIGS. 3 and 4, in a practical implementation strategy coating 50 may include various molded-in features for assisting in support, cushioning, and vibration and load attenuation. To this end, coating 50 may further include a plurality of integral pads that are positioned vertically between at least one of base plate 46 and rail plate 48 and underlying substrate 100. In FIG. 3 and FIG. 4 pads 51 are shown located at forward and rearward locations vertically between rail plate 48 and an expected location of an underlying substrate, whereas another pad 53 is shown extending between pads 51. Referring back to FIG. 5, it can be seen from the profile of rail plate 48, stepped up from core 62 to outboard section 58, that pads 51 and 53 will provide a mass of elastomeric material or the like that supports rail plate 48 and potentially also the adjacent end of base plate 46 upon the substrate. A like plurality of pads may be positioned vertically beneath second outboard body section 60 when mechanism 12 is assembled for service. Those skilled in the art will contemplate various modifications to the illustrated embodiments with respect to the positioning and configuration of pads formed by the non-metallic material of coating 50. For example, in alternative embodiments the relative sizes and/or the relative shapes of rail plate 48 and base plate 46 might be different, and a different location, shape, thickness, or relative proportioning of support between base plate 46 and rail plate 48 might be employed. Drainage holes 82 are shown in upper side 14 of fastener body 12, and extend vertically through fastener body 12 to drain water to the underlying substrate.

Also shown among the various figures are bores 74 and 76 that receive anchors 20 and/or clamping mechanisms 42 and 44, respectively. In a practical implementation strategy, fastening mechanism 10 is structured to enable lateral adjustability, a feature altogether lacking or commonly inadequate in known designs. To this end, it can be seen that first bore 74 and second bore 76 are non-circular, each having a relatively greater extent in lateral directions, i.e. toward or away from ends 70 and 72, and a relatively lesser extent in fore and aft directions, i.e. toward or away from edge 134 and edge 136. Anchor bolts or the like within bores 74 and 76 can be positioned relative to base plate 46 through a range of lateral positions. Base plate 46 is also shown to further include a first set of indexing elements 52 adjacent first bore 74 and a second set of indexing elements 52 adjacent second bore 76. Each of the sets of indexing elements 52 is structured to couple with a clamping mechanism, such as a clamping collar 80 as shown in FIG. 4, for clamping anchors within a substrate to base plate 46. It will therefore be appreciated that the indexing elements 52, which may have the form of sets of indexing teeth, can enable mechanism 12 to be clamped to an underlying substrate at a range of clamping locations. Such lateral adjustability enables a technician installing mechanism 12 to couple new track to a substrate, or retrofitting mechanism 12 in place of existing fasteners, to shift base plate 46 and thus rail plate 48 to the left or to the right to provide for or set a gauge of parallel track rails. Such lateral adjustability is also observed to be desirable in the case of compensating for track wear, which in various instances can be addressed at least in part by laterally adjusting track rail fastening mechanisms. Alternative embodiments are contemplated where, rather than indexing teeth, a system of slots and tabs, complementary protrusions and indentations, or a variety of other structures used that can serve as indexing elements. Shims could be installed for indexing purposes in some instances. Where a collar such as collar 80 is used, complementary teeth can be provided that are engaged with indexing teeth 52 on base plate 46. The complementary teeth of collar 80 are hidden from view in FIG. 4 but could have a shape that fits within and among indexing elements 52 and is substantially identical to indexing elements 52, extending laterally for most or all of a width of collar 80 in lateral directions.

INDUSTRIAL APPLICABILITY

Referring to the drawings generally, when it is desired to fasten a track rail to a substrate, such as upon installation of new track or retrofitting of fastening mechanisms to an old track, base plate 46 may be attached to an underlying substrate by way of fasteners such as anchors 20 extending through bores 74 and 76 in the opposite lateral ends 70 and 72 of base plate 46. Rail plate 48 may be positioned, by way of the attaching of base plate 46, in a service orientation relative to the underlying substrate. Those skilled in the art will appreciate that rail support surface 64 will be thusly positioned either at a horizontal orientation, or an orientation tilted slightly inward toward a center line running longitudinally between adjacent track rail paths. In one implementation, clamping mechanisms 42 and 44 may include anchoring bolts that are received within threaded sleeves or the like embedded in the underlying substrate. In other instances, clamping mechanisms 42 and 44 could include only the nuts, washers or other hardware that is used to attach mechanism 10 to a preexisting anchor held fast within a substrate.

With base plate 46 and rail plate 48 positioned as desired and mechanism 10 clamped to the underlying substrate, a track rail may be clamped against rail support surface 64 of rail plate 48, so as to directly contact rail support surface 64 or to contact a layer of overmolded coating or another material placed upon rail support surface 64. As described herein, clips 26 and 28 may be used in a generally conventional manner to clamp a track rail such as track rail 18 to mechanism 10, and thereby support track rail 18 relative to the underlying substrate. Clamping track rail in this manner establishes a load transmission path between track rail 18 and the substrate by way of resilient non-metallic material of coating 50. As discussed above, base plate 46 may be attached at one of the plurality of lateral attachment positions within an available range of lateral attachment positions. Clamping track rail 18 can therefore also include clamping track rail 18 at a selected lateral mounting location relative to pre-established anchoring locations so as to establish the load transmission path by way of the non-metallic material of coating 50 that is resident within gap 90.

Those skilled in the art will be familiar with other track fixation systems where a base clamped to a substrate surrounds a rail plate or the like. In such a strategy, while the base may be robustly supported upon the substrate, and the track rail capable of moving slightly relative to the base, various disadvantages or limitations result from such a design. On the one hand, a lateral length of a track rail fastening mechanism, oriented transverse to the rail, is sometimes limited due to proximity of a vertical wall such as a wall of an adjacent structure or some other permanent feature adjacent a rail line. With such a limitation on length, lateral stiffness of the track rail fastening mechanism of conventional design may be less than optimal, allowing the rail to rotate relatively more easily than what would otherwise be desired. The undesired ease of rotation is believed to be due at least in part to a lack of vertical supporting elastomeric material under lateral sides of the rail plate. The present disclosure provides for substantially higher lateral stiffness at least in part because the rail plate is not confined in length by the surrounding base plate, since the base plate is instead itself surrounded by the rail plate. While adjacent walls or other structures can still place limits on the overall length of a track rail fastening mechanism, among other things the present disclosure enables more of the available length to be taken up by rail plate than conventional approaches. The present disclosure also provides close proximity of anchor bolts to the rail and, in return, full vertical support by elastomeric material between the substrate and lateral ends or all four angles of the rail plate. The design thus has robust lateral stability resulting in reduced rail tilting, in a fastener having a relatively short lateral length. Such a solution can also be beneficial in scenarios where two competing requirements need to be met at the same time, such as soft elastomeric material in conjunction with short lateral length fasteners.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A fastening mechanism for coupling a track rail to a substrate comprising:

a rail plate formed of a metallic material and including a lower side structured to face a substrate, and an upper side including a rail support surface extending between a front edge and a back edge of the rail plate, and the rail plate further including an outer perimeter and an inner perimeter defining an opening;

a base plate formed of a metallic material, the base plate including a first lateral end and a second lateral end having a first bore and a second bore formed therein, respectively, and each structured to receive an anchor extending into the substrate, and the base plate being positioned within the opening such that the rail plate surrounds the base plate and a gap extends peripherally between the rail plate and the base plate; and an overmolded coating formed of a non-metallic material that is resiliently deformable relative to the metallic material, and the overmolded coating encasing the rail plate and the base plate and at least partially filling the gap to resiliently couple the rail plate and the base plate together.

2. The mechanism of claim 1 wherein the gap has a non-uniform contour and extends peripherally around the base plate such that the base plate is isolated from contact with the rail plate.

3. The mechanism of claim 2 wherein the base plate includes a plurality of prongs projecting in a forward direction and a plurality of prongs projecting in a rearward direction.

4. The mechanism of claim 3 wherein the rail plate includes a first outboard body section, a second outboard body section, and a core extending laterally between the first outboard body section and the second outboard body section, and a stepped up profile from the core to each of the first outboard body section and the second outboard body section.

5. The mechanism of claim 4 further comprising a first clip receiver attached to the first outboard body section, and a second clip receiver attached to the second outboard body section.

6. The mechanism of claim 5 wherein each of the first clip receiver and the second clip receiver is positioned within a footprint of the rail plate.

7. The mechanism of claim 4 wherein the overmolded coating includes a first pad positioned vertically below the first outboard body section and a second pad positioned vertically below the second outboard body section.

8. The mechanism of claim 1 wherein each of the first bore and the second bore is non-circular having a relatively greater extent in lateral directions and a relatively lesser extent in fore and aft directions.

9. The mechanism of claim 1 wherein the base plate further includes a first set of indexing elements adjacent the first bore and a second set of indexing elements adjacent the second bore, and each being structured to couple with a clamping collar for clamping anchors extending into the substrate to the base plate.

10. A system for coupling a track rail to a substrate comprising:

a fastening mechanism including a rail plate, a base plate, and an overmolded coating encasing the rail plate and the base plate, each of the rail plate and the base plate being formed of a metallic material and the overmolded coating being formed of a non-metallic material;

the rail plate including a lower side structured to face a substrate, and an upper side including a rail support surface extending between a front edge and a back edge of the rail plate, and the rail plate further including an outer perimeter and an inner perimeter defining an opening;

the base plate including a first lateral end and a second lateral end having a first bore and a second bore formed therein, respectively, and each structured to receive an anchor extending into the substrate; and the base plate being positioned within the opening such that a gap extends peripherally between the rail plate and the base plate, and the overmolded coating at least partially filling the gap.

11. The system of claim 10 wherein the base plate includes a first set of indexing elements adjacent to the first bore, and a second set of indexing elements adjacent to the second bore.

12. The system of claim 11 wherein each of the first set of indexing elements and the second set of indexing elements includes indexing teeth, and further comprising a first clamping collar including a first set of complementary teeth engaged with the indexing teeth of the first set and a second clamping collar including a second set of complementary teeth engaged with the indexing teeth of the second set.

13. The system of claim 10 wherein the overmolded coating further includes a plurality of pads positioned vertically beneath the rail plate.

14. The system of claim 13 wherein the rail plate includes a first outboard body section, a second outboard body section, and a core extending between the first outboard body section and the second outboard body section, and wherein the plurality of pads are positioned vertically beneath the first outboard body section and the second outboard body section.

15. The system of claim 10 wherein the gap has a non-uniform contour and extends peripherally around the base plate such that the base plate is isolated from contact with the rail plate.

16. The system of claim 10 wherein a first section of the rail support surface extends between the opening and the front edge, and a second section of the rail support surface extends between the opening and the back edge.

* * * * *